US007459855B2

(12) United States Patent
Bearzatto et al.

(10) Patent No.: US 7,459,855 B2
(45) Date of Patent: Dec. 2, 2008

(54) LOW-SPURIOUS-RADIATION MICROWAVE TUBE

(75) Inventors: Claude Bearzatto, Paris (FR); Jean-Luc Piquet, Les Ulis (FR); Daniel Plard, La Celle Saint Cloud (FR)

(73) Assignee: Thales (FR)

( * ) Notice: Subject to any disclaimer, the term of this patent is extended or adjusted under 35 U.S.C. 154(b) by 312 days.

(21) Appl. No.: 10/555,653

(22) PCT Filed: Apr. 16, 2004

(86) PCT No.: PCT/EP2004/050557

§ 371 (c)(1),
(2), (4) Date: Sep. 29, 2006

(87) PCT Pub. No.: WO2004/100204

PCT Pub. Date: Nov. 18, 2004

(65) Prior Publication Data

US 2007/0046384 A1 Mar. 1, 2007

(30) Foreign Application Priority Data

May 6, 2003 (FR) ..... 03 05509

(51) Int. Cl.
*H01J 23/02* (2006.01)

(52) U.S. Cl. ..... 315/5.38; 315/5.14; 315/39; 330/45; 330/43; 331/83; 331/82; 333/35; 333/157

(58) Field of Classification Search ..... 315/3.5, 315/4, 5.14, 5.38, 5.42, 39, 39.3; 330/43–45; 331/79, 82, 83; 333/35, 135, 157
See application file for complete search history.

(56) References Cited

U.S. PATENT DOCUMENTS

| | | | | |
|---|---|---|---|---|
| 2,853,644 | A * | 9/1958 | Field | 315/3.5 |
| 4,393,332 | A * | 7/1983 | Symons | 315/4 |
| 5,043,630 | A * | 8/1991 | Faillon et al. | 315/5 |
| 7,034,463 | B2 * | 4/2006 | Nobe | 315/3.5 |

* cited by examiner

*Primary Examiner*—Haissa Philogene
(74) *Attorney, Agent, or Firm*—Lowe Hauptman Ham & Berner, LLP

(57) ABSTRACT

The invention relates to a microwave tube comprising an electron gun generating an electron beam in a cylindrical microwave structure of the tube. The microwave structure delivers a microwave at one output. A collector for collecting electrons from the beam comprising at least one electrode that is mechanically coupled to the microwave structure via a dielectric, the mechanical coupling forming a radial waveguide for propagating spurious microwave radiation (Pr) from the tube. In order to attenuate the spurious radiation from the tube, the radial waveguide (Wg) includes at least one quarter-wave microwave trap having, at least at the operating frequency F of the tube, an open circuit for the microwave propagating in said radial waveguide for propagating spurious radiation.

10 Claims, 8 Drawing Sheets

LOW-SPURIOUS-RADIATION MICROWAVE TUBE

FIELD OF THE INVENTION

The invention relates to microwave tubes, especially klystrons or TWTs (traveling wave tubes).

BACKGROUND OF THE INVENTION

FIG. 1 is a simplified diagram of a microwave electron tube comprising essentially three main subassemblies, namely an electron gun 12, a microwave structure 14 and a collector 16.

The electron gun 12 comprises a cathode 18 that generates an electron beam 20 in the microwave structure 14, where the electron beam 20 interacts with an electromagnetic wave created in the microwave structure. More precisely, the electron beam gives up some of its energy to the electromagnetic wave.

The collector 16 thermally dissipates the kinetic energy of the electrons of the beam 20 that remain after interaction with the electromagnetic wave.

The electrons emitted by the cathode are accelerated by a voltage $V_0$ applied between the cathode and the anode of the tube and are characterized in a current $I_0$.

The microwave structure is composed of resonant cavities and drift tubes in the case of klystrons, and of a helix or coupled cavities in the case of a TWT.

The microwave structure of the TWT includes an input window 22 on the side facing the gun of the tube, in order to inject the power Pe to be amplified in the structure, and an output window 24, on the side facing the collector, for extracting the amplified output power Ps.

The gain $G=10\log_{10}(Ps/Pe)$ is around 40 to 50 dB and the interaction efficiency $\eta_i=Ps/V_0I_0$, which is generally between 30 and 60%. These input and output windows are dielectric members, usually made of alumina, which transmit, almost without loss, in the operating frequency band of the tube, the input microwave power Pe, into the structure, and the output power Ps, to the outside of the structure, depending on the case, while isolating the inside of the tube, which is under vacuum (residual pressure $\leqq 10^{-7}$ torr), from the external atmosphere.

Another likewise essential subassembly of the tube is a magnetic circuit 40 (see FIG. 1) that surrounds the microwave structure 14, comprising an electromagnet or permanent magnets associated with pole pieces for conducting the magnetic flux into the electron beam 20 which is thus focused, that is to say maintained at a small and approximately constant diameter. This magnetic circuit is external to the vacuum chamber of the tube, except sometimes for certain pole pieces.

An ion pump 42, indicated in FIG. 1, is used to maintain the vacuum inside the tube-this pump is not always necessary.

The collector 16 is a hollow cylinder, as indicated in FIG. 1. The electrons from the beam bombard the internal walls 44 of the collector 16, which heat up. The heat is then extracted via the outer walls of the collector, which are cooled, depending on the power densities in question, by forced air, by water circulation or by radiation.

The collector is at the potential of the body of the structure 14 of the tube, that is to say at ground potential, the cathode being at potential $-V_0$.

The collector 16 may be directly attached to the body 14, as indicated in FIG. 1. The collector may also be electrically isolated from the body, but connected to the latter via an external electrical connection.

FIG. 2 shows a partial view of a TWT comprising a microwave structure 50 having coupled cavities 52 and a collector 58 attached to the microwave structure 50 and electrically isolated from the body of the tube, and especially from an upper pole piece 60, via an annular insulator 62. The electron beam 20 output by the microwave structure penetrates the collector 58 via an aperture 64. Electrons following various paths 66 are collected by the internal walls 68 of the collector.

It is often necessary to separately measure the current $I_b$ of the electrons that are intercepted by the microwave structure and the current $I_{coll}$ of the electrons that reach the collector. These two currents have very different amplitudes, often with an $I_b/I_{coll}$ ratio of a few %, or even 1% or less.

To do this, the collector is isolated from the body by the insulator 62, for example made of a ceramic, often alumina (see FIG. 2). FIGS. 3*a* and 3*b* show schematically the electrical connections of the various elements of the tube of FIG. 1 to the power supply AL 70. It is the body of the tube which in general is connected directly to ground G, for practical reasons, as it is of course connected to the external installation via the input and output waveguides, often via the armature of the electromagnet, and sometimes via the systems for tuning the cavities, thermal probes. The hydraulic connections for the collector, when they exist, must therefore be sufficiently insulated to force the current $I_{coll}$ not to follow them as return path, via ground, back to the + pole of the power supply.

The collector is isolated from the body by an annular ceramic piece 62 (FIG. 2), or in general by any other insulator, which fulfils several important roles:

- electrical isolation between body (or pole piece) 60 and collector 58;
- sealing and maintaining the vacuum inside the tube;
- mechanical strength, in order to keep the collector firmly in place on the body, despite certain vibration that occasionally arises from the cooling system and despite the knocks that it may receive when being transported and installed.

However, this body 60/collector 58 isolation appears, from the microwave viewpoint, as a true radial line, itself composed of several lines of different impedances $Z_1, Z_2, \ldots Z_i$ in series.

FIG. 4 shows a detailed view of the space Wg for coupling between a body 80 and the collector 82 of a microwave tube. This space is shown as a series of lines of impedances $Z_1$, $Z_2$, $Z_3$ in series between the inside and the outside of the tube. The value of these impedances is related to the geometrical characteristics (h, d, etc.) of the lines and to the presence or absence of a ceramic insulator ($\in_0$, $\sigma$). The reader may refer to the work "Fields and waves in communication electronics" by Ramo, Whinnery et al. (published by John Wiley & Sons).

It follows that if electromagnetic energy is present at the input $E_{coll}$ of the collector, it may be coupled to this radial waveguide and can radiate (Pr) to the outside.

The presence of electromagnetic energy at the input of the collector may be due to leaks from the output cavity (or from the helix), or else the drift tube connecting it to the collector, i.e. to the cutoff at the operating frequency F and generally at 2F. However, this tube is often too short, therefore allowing evanescent mode transmission.

This electromagnetic energy may also arise from one of the many resonances of the collector that are excited to F, 2F, etc. by the electron beam, again slightly modulated.

In other words, the radial waveguide can present to the electron beam an impedance $Z_{ed}$ sufficient for the beam, again slightly modulated, to give up thereto microwave energy at a low but not insignificant level, which is then radiated to the outside via the radial waveguide between body and collector.

Now, the specifications often impose a very low level of microwave loss, for example $Pr<0.1$ mW/cm$^2$ at 10 cm over the entire external surface of the tube.

SUMMARY OF THE INVENTION

The problem is therefore to minimize the spurious radiated power Pr coming from the input of the collector via the body/collector isolation, which can be likened to a radial waveguide.

To attenuate the spurious radiation from microwave tubes of the prior art, the invention proposes a microwave tube comprising an electron gun generating an electron beam in a cylindrical microwave structure of the tube, the microwave structure delivering a microwave at one output, a collector for collecting electrons from the beam comprising at least one electrode that is mechanically coupled to the microwave structure via a dielectric, the mechanical coupling forming a radial waveguide for propagating spurious microwave radiation from the tube, characterized in that, in order to attenuate the spurious radiation from the tube, the radial waveguide includes at least one quarter-wave microwave trap having, at least at the operating frequency F of the tube, an open circuit for the microwave propagating in said radial waveguide for propagating spurious radiation.

The idea is to employ "λ/4 traps" at the radial waveguide appearing in the mechanical coupling between the body of the tube containing the microwave structure and the collector. These waveguides are those used, for example, on the coupling flanges of waveguides or those used for mounting antennas or crystal detectors.

In a first embodiment of the microwave tube according to the invention, the radial waveguide includes a microwave trap at the operating frequency F of the tube, having a cylindrical slot collinear with the axis of revolution ZZ' of the tube and emerging in said radial waveguide for coupling the body to the collector of the tube.

In an alternative form of this first embodiment of the microwave tube according to the invention, the radial waveguide includes another microwave trap at a frequency 2F, having another cylindrical slot collinear with the axis of revolution ZZ' of the tube and emerging in said radial waveguide for coupling the body to the collector of the tube.

Another type of collector exists that is not only isolated from the body but also composed of several electrodes, each being at an intermediate potential between $-V_0$ and ground. The potentials are therefore chosen so that the electrons are decelerated before their impact on the internal walls and thus the dissipated thermal power is as low as possible. After interaction, the dispersion in the velocities at the input of the collector is large-it is for this reason that several electrodes are used, each slowing down the electrons occupying such or such part of the velocity spectrum. This technique involving what are called "depressed collectors", is most particularly applied to TWTs that are cooled by air or by radiation. It allows the efficiency to be appreciably increased by reducing the dissipated power, equal to $V_0I_0$ with no depressed collector, as we saw above.

The proposed invention applies to all types of collector, in particular between the various electrodes of "depressed"-type collectors, comprising several mechanically coupled electrodes, each coupling between two consecutive electrodes forming a radial waveguide for propagating spurious microwave radiation (Pr) from the tube, apart from the microwave trap between the body and a first electrode, and, in order to attenuate the spurious radiation from the tube, the radial waveguide between two consecutive electrodes includes at least one quarter-wave microwave trap having, at least at the operating frequency F of the tube, an open circuit for the microwave propagating in said radial waveguide for propagating spurious radiation. However, the presentation that follows will refer to a "non-depressed" collector, that is to say a standard collector, for the sake of simplifying the description.

BRIEF DESCRIPTION OF DRAWINGS

The invention will be more clearly understood from the exemplary embodiments according to the invention, with reference to the appended drawings in which.

DETAILED DESCRIPTION OF EMBODIMENTS

Figure 5A:
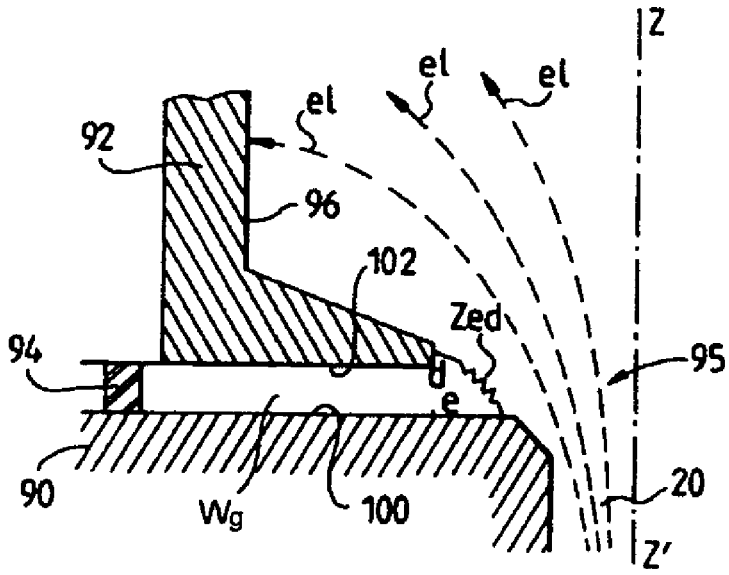
FIG. 5*a* shows a simplified partial view, in cross section, of the coupling zone between a body and a collector of a microwave tube.

FIG. 5*a* shows a simplified partial view, in cross section in a plane passing through the axis ZZ' of revolution of the microwave structure of the tube, of the coupling zone between a body 90 and a collector 92 of a microwave tube.

The collector 92 is mechanically coupled to the body of the tube containing the microwave structure via an insulator 94. The electron beam 20 output from the microwave structure penetrates, along the ZZ' axis, via an opening 95 into the collector and is then thermally dissipated by striking the internal walls 96 of the collector (see the lines el).

The space Wg between the body 90 and the collector 92 behaves, as mentioned above, as a microwave line or radial waveguide. This space is shown in FIG. 5*a* as a toroidal volume of very small thickness lying between a face 100 of the body and a face 102 of the collector, said faces being separated by the insulator 94.

Figure 5B:
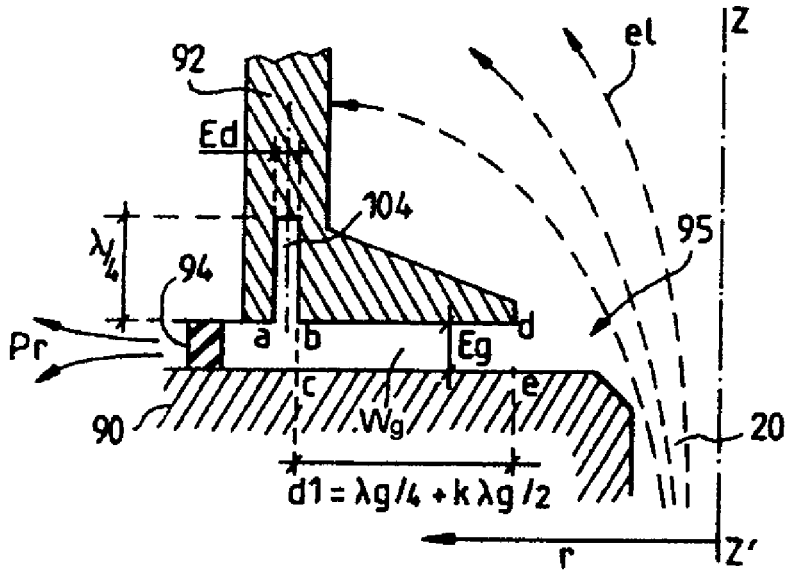
FIG. 5*b* shows a first embodiment of the microwave trap of a microwave tube according to the invention.

FIG. 5*b* shows a first embodiment of a microwave trap of a microwave tube according to the invention.

These traps are machined or added to the base, or better still machined in the base, of the cylinder of the collector, the thickness of which, at this point, is often sufficient to accommodate one or more coaxial slots.

The collector 92 includes a circular slot 104 around the ZZ' axis with a rectangular cross section and a depth equal to λ/4, the slot emerging via one side in the radial waveguide (the space Wg in FIG. 5*a*), λ=c/F being the wavelength in the coaxial slot at the operating frequency F of the tube, the slot being at a distance d1 from the point where the radial waveguide emerges on the same side as the internal opening 95 of the collector 92, such that:

$$d1=(\lambda g/4+k\lambda g/2)$$

λg being the wavelength in the radial waveguide (the space Wg);

k being zero or an integer; and c being the velocity of light in the medium in question, here, a vacuum, so as to create an infinite impedance in the slot 104, and therefore an abrupt mismatch that reflects most of the microwave power coming from the radial line at the frequency F.

The transmitted power, therefore the power Pr radiated to the outside of the tube, through the insulator 94 then becomes very small.

The wavelength λg in the radial waveguide depends on the portion in question of the waveguide, and in particular on the radial distance r relative to the ZZ' axis of the tube.

However, we should point out that the widths of the waveguides shown respectively by the width Ed of the slot (the distance ab in FIG. 5*b*) and the thickness Eg of the radial waveguide (distance bc) are not infinitely small compared with the lengths of these same waveguides-the position of the "brought-back" open circuit (infinite impedance) is therefore poorly defined, and the electromagnetic waves can then partly circumvent the trap owing to the local presence of higher-order modes. Consequently, the widths Ed and Eg must be as small as possible in order to achieve the best possible blocking of the radiated spurious power.

The electron beam is modulated not only at the operating frequency F of the tube but also, to a lesser extent at 2F and beyond, it being understood that at 3F, 4F, etc., this modulation is quite negligible.

Figure 5C:
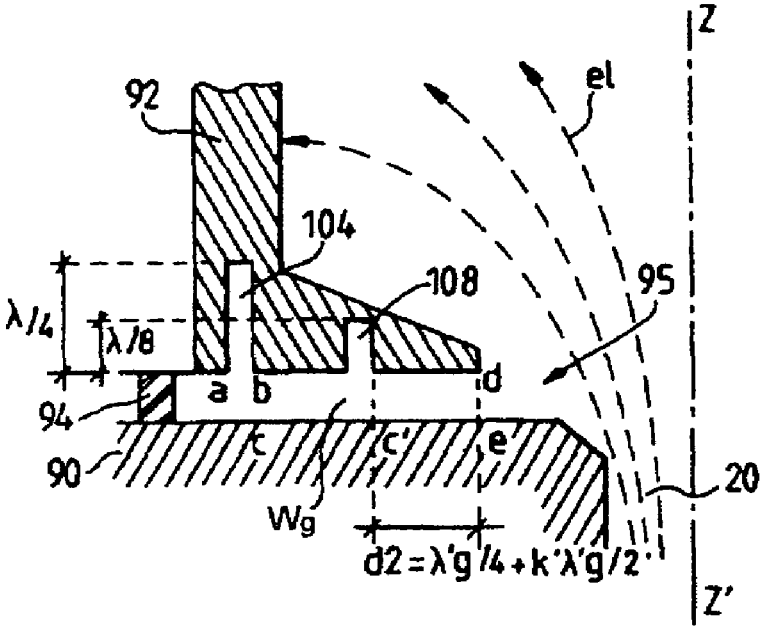
FIG. 5*c* shows an alternative embodiment of the microwave tube according to the invention.

FIG. 5*c* shows an alternative embodiment of the tube according to the invention. In this embodiment of the tube, the collector 92 includes a second slot 108, like the first slot 104, of circular shape around the ZZ' axis, having a rectangular cross section and a depth equal to λ/8, said second slot emerging in the same way alongside the slot in the radial waveguide (the space Wg of FIG. 5*a*), the second slot 108 being at a distance d2 from the point where the radial waveguide emerges on the same side as the internal opening 95 of the collector 92 such that:

$$d2=(\lambda'g/4+k'\lambda'g/2)$$

with k' being an integer and λ'g being the wavelength in the radial waveguide (the space Wg) at the frequency 2F (see FIG. 5*c*).

Thus, any power at the frequency 2F will also be blocked and cannot be radiated to the outside of the tube.

It should be noted that the radial line between the open circuit at the slot 104 "bc" and its opening "de", at the input 95 of the collector 92, is the seat of stationary waves the intensity of which is higher the closer the coupling impedance $Z_{ed}$ between the body and the collector (see FIG. 5*a*) is to the internal impedance of the microwave generator, equivalent to the modulated beam at the input of the collector.

In other words, a voltage $V_{ed}=Z_{ed}MI_b(F)$, where:

M represents the beam/radial waveguide coupling;

$I_b(F)$ represents the component of the beam current at the frequency F; and $Z_{ed}$ represents the impedance at the input of the radial line, is induced at the input of the radial line and because of the almost total reflection by the open circuit at "bc". This portion of the radial line is the seat of stationary waves.

At certain places, large fields may therefore appear, with the risk of a breakdown or a multifactor phenomenon, always very noisy.

Furthermore, the voltage $V_{ed}$ may be such that it reflects electrons back toward the microwave structure, therefore producing spurious modulations and oscillations.

According to the invention, the solution giving rise to the embodiments described above is therefore that the waveguide has, at its input at "ed", a zero impedance or an impedance of very low value ($V_{ed}\approx 0$).

This justifies the value of the distance d1, already indicated above, between the first slot 104 of the trap and the input "e" of the waveguide at the opening 95 of the collector. This length d1 or "ce" in FIG. 5*b* is such that the open circuit at the slot 104 at "cb" is brought back to the input of the waveguide, at "de" as a short circuit.

It will be recalled that the length "ce" is therefore equal to λg/4 (or λg/4+kλg/2, k being zero or an integer) with λg the wavelength in the radial waveguide, which varies with the radius r in question, i.e. λg(r). The analytical calculations of λg are very complex and the adjustments in length, and in general the dimensions, of the trap are performed by experimental simulation and by computer.

Applying the same reasoning transposed to the frequency 2F, a second slot 108 will be placed at a point "c'" in the waveguide, such that the distance "c'e" (i.e. d2 in FIG. 5*c*) between the position "c'" of the second slot 108 in the radial waveguide and the input "e" of the waveguide, is given by:

$$\text{length } c'e=\lambda'g/4, \text{ or } \lambda'g/4+k'\lambda g/2,$$

where k' is an integer and λ'g is the wavelength in the radial waveguide at the frequency 2F.

To summarize, the base of the collector 92 is machined so as to create one or more "quarter-wave" traps or slots which bring back imaginary open circuits across the radial waveguide formed by the body 90/collector 92 insulation. These imaginary open circuits prevent most of the power to pass from the inside of the tube to the outside, and therefore block any spurious radiation.

Furthermore, the positions of these traps are chosen so that the impedance brought back at "ed", at the input of the radial waveguide, is zero at the frequencies in question, generally the operating frequency F of the tube, and 2F, (distance ce=λg/4 or λg/4+kλg/2, where k is an integer and λg is the wavelength of the radial waveguide at the frequency F, and likewise at 2F, where λ'g is the wavelength in the radial waveguide at the frequency 2F).

Figure 6:
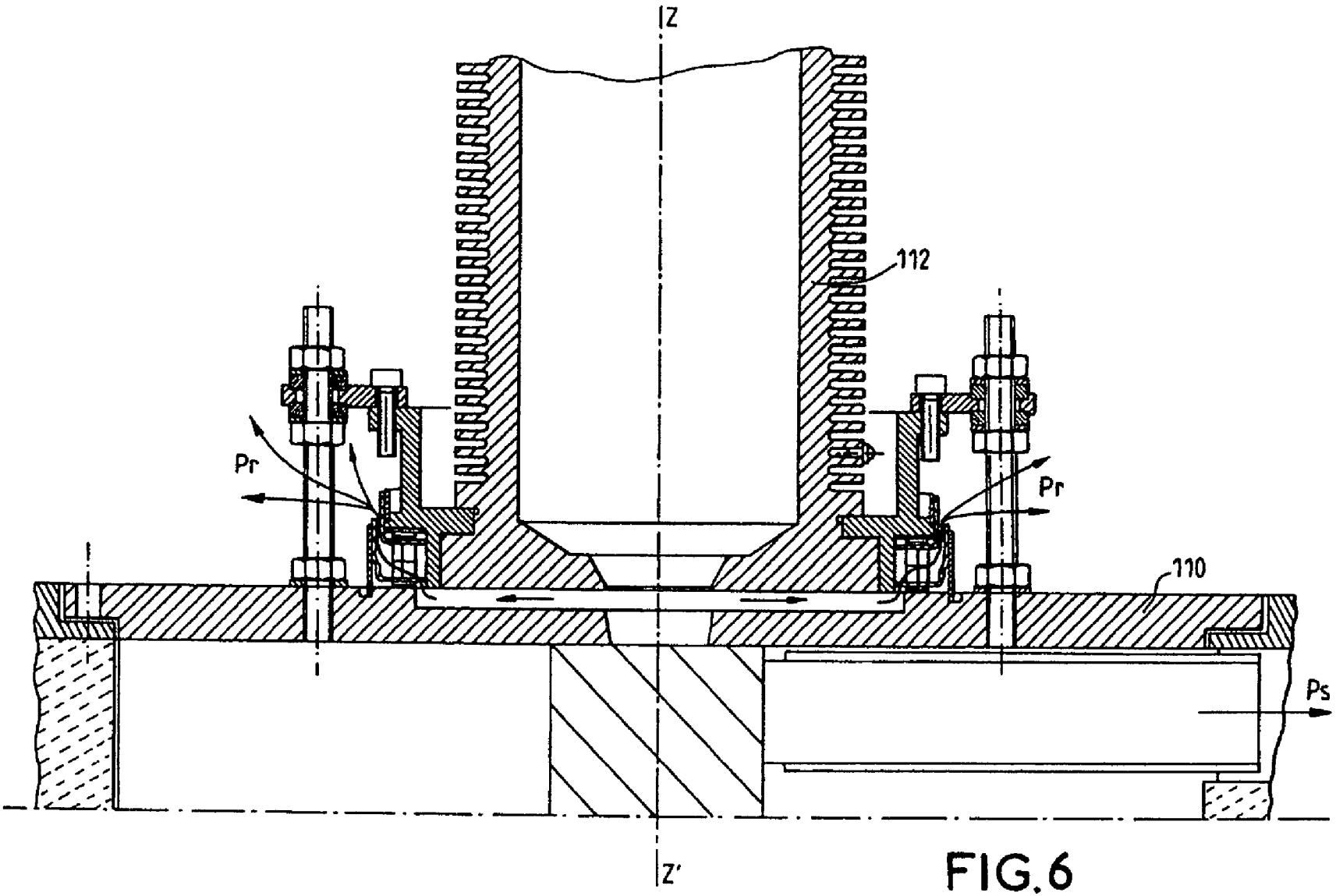
FIGS. 6 and 7 show respectively partial views of the coupling zone between the body and the collector of a tube of the prior art without a trap, and of a tube with a trap according to the invention.
Figure 7:
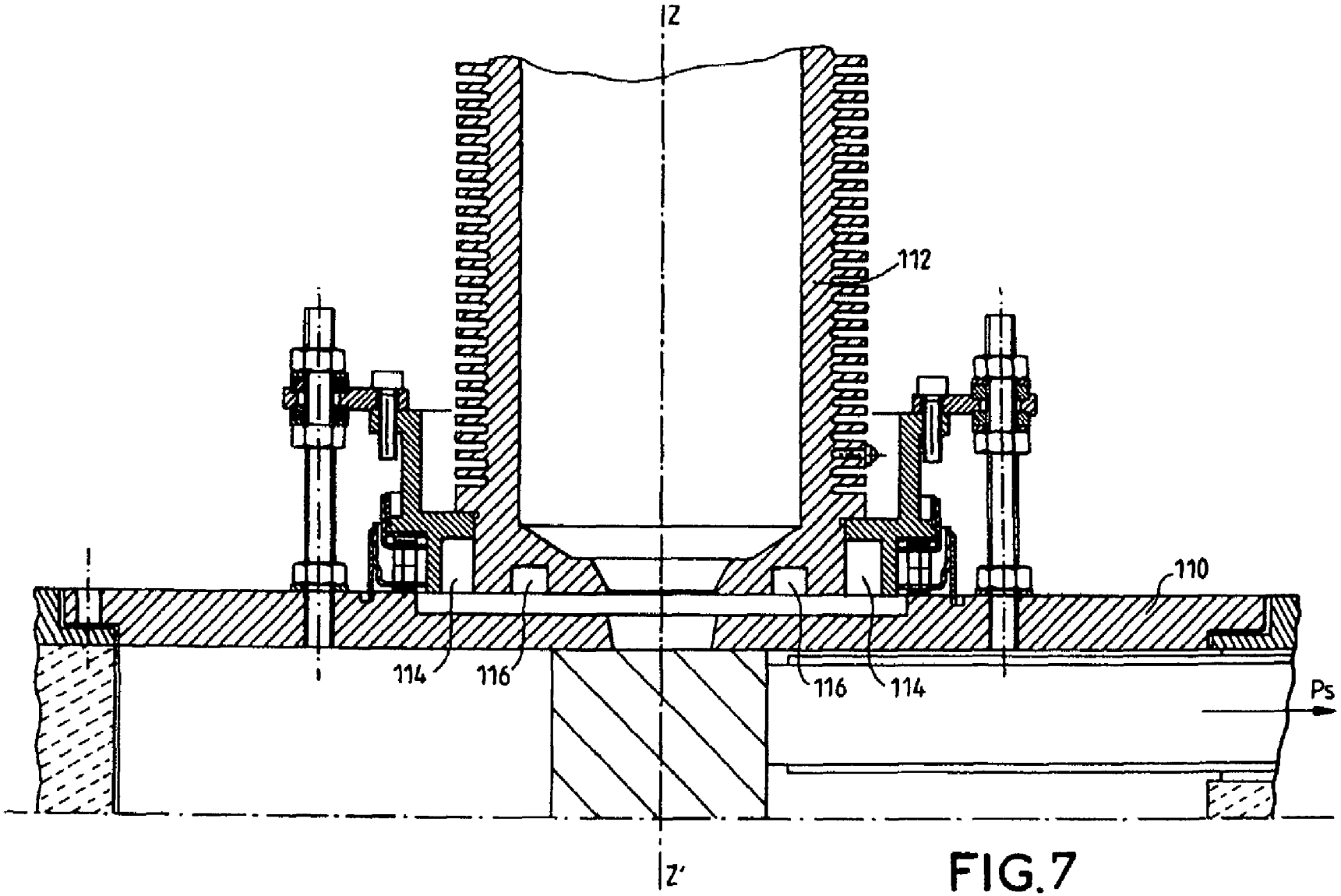

FIGS. 6 and 7 show respectively partial views of the coupling zone between the body 110 and the collector 112 of a tube with no microwave traps and the same coupling zone of the tube produced according to the invention, comprising two traps having two slots 114, 116 for the frequencies F and 2F respectively.

The length of the slots is λ/4, where λ=c/F, or else λ/8, c being the velocity of light in the medium in question, that is to say that of the slot. This is generally a vacuum, but the slots may also be filled with a dielectric of low dielectric constant $\in_r$ (>1). In this case, λ, and also the length of the slots, is reduced in the ratio of the square root of $\in_r$ relative to the case in which the slots are in a vacuum. It is therefore conceivable to reduce the length of the slots by a factor of about three if these slots are filled with alumina ($\in_r$=9).

Figure 1:
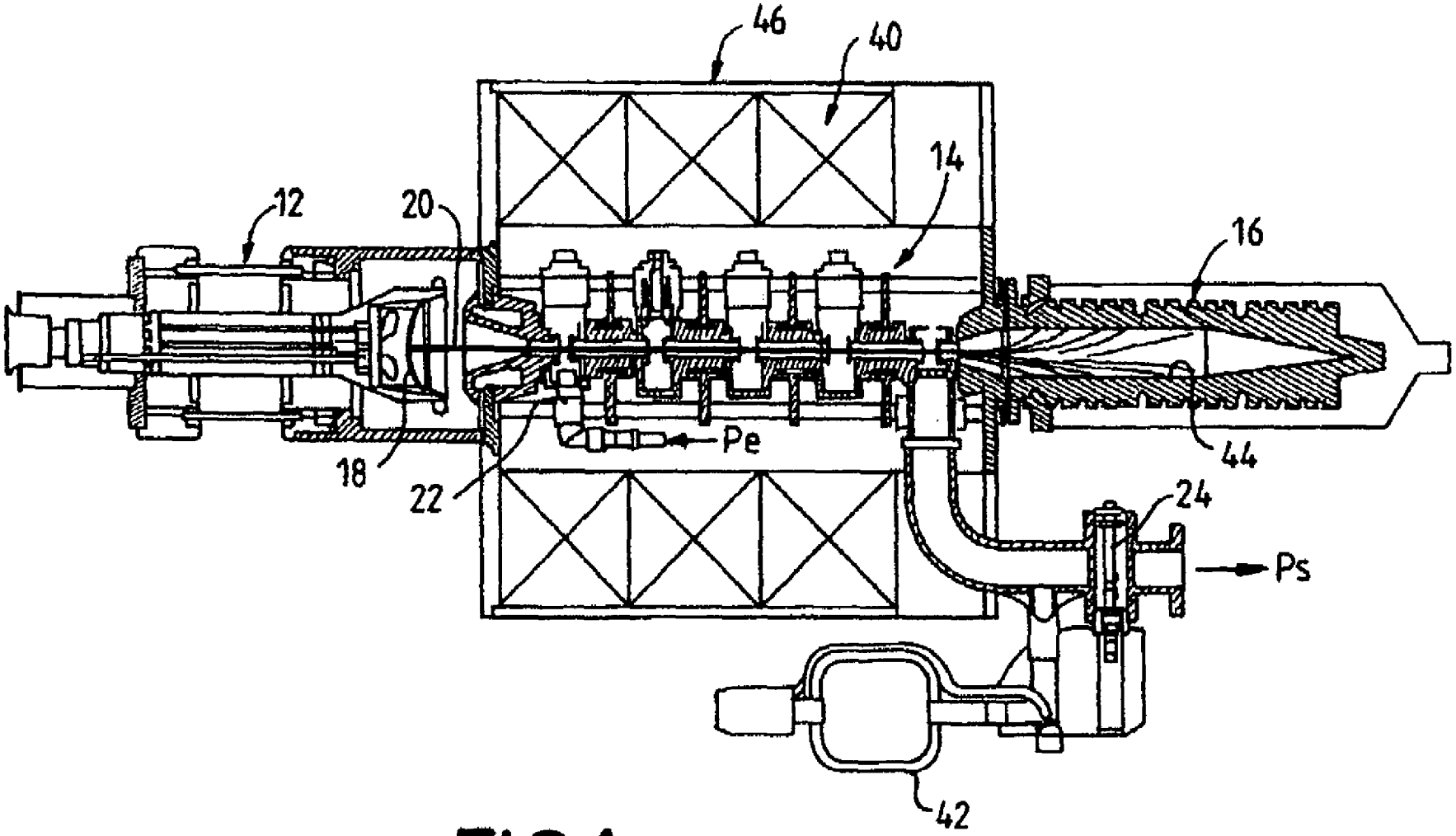
FIG. 1, already described, shows a simplified diagram of a microwave electron tube.
Figure 2:
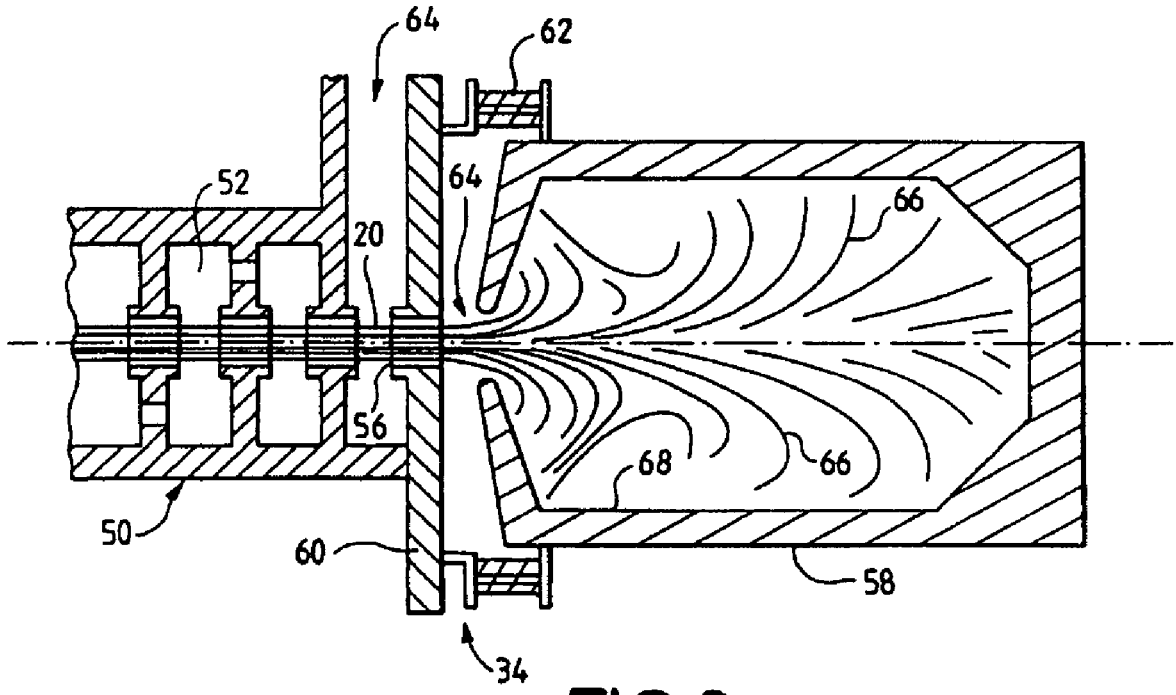
FIG. 2, already described, shows a partial view of a TWT.
Figure 3A:
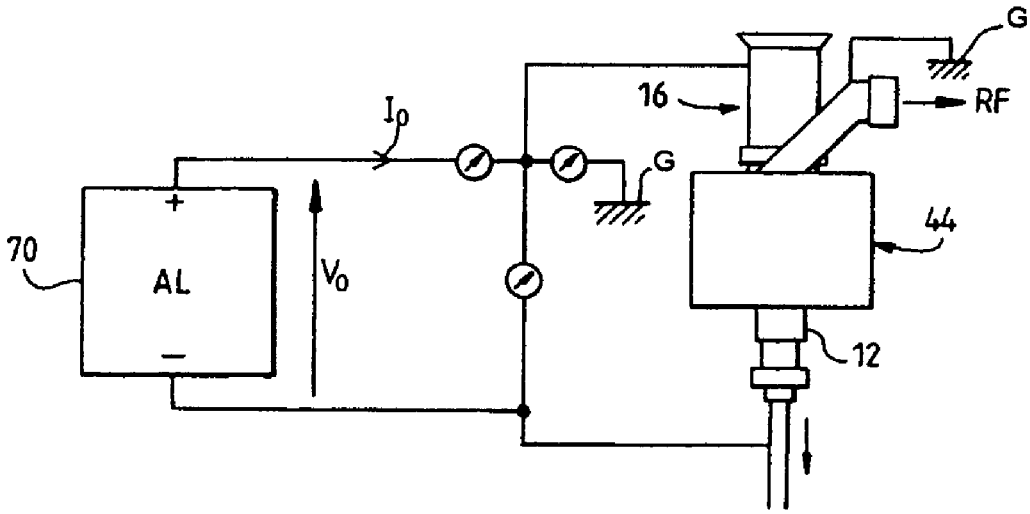
FIGS. 3*a* and 3*b*, already described, show the connections to the power supply of the various elements of the tube of FIG. 1.
Figure 3B:
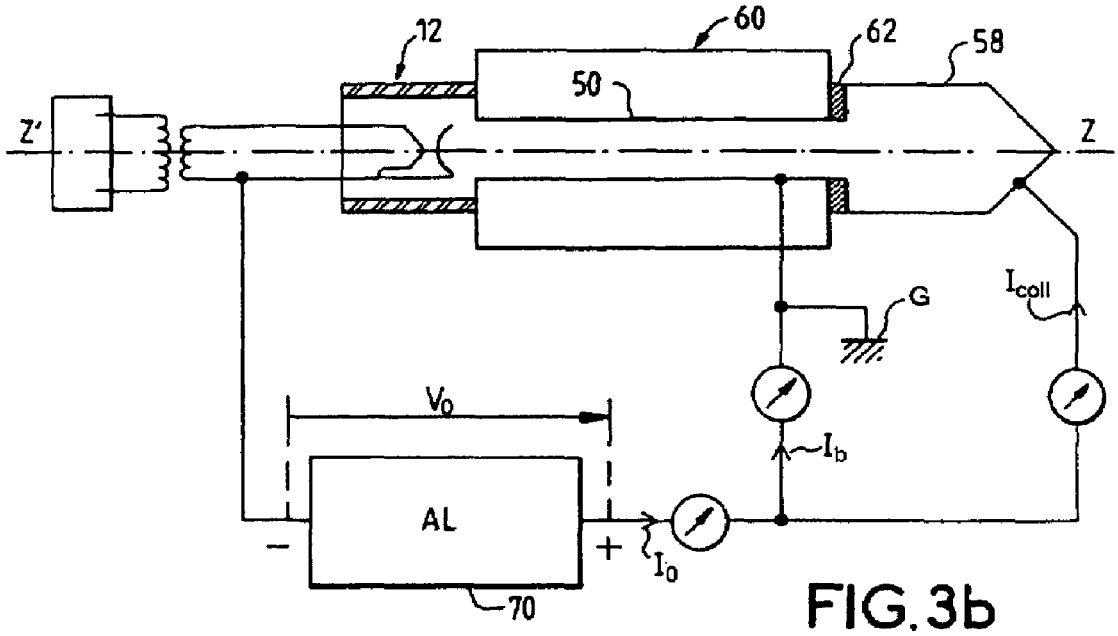
Figure 4:
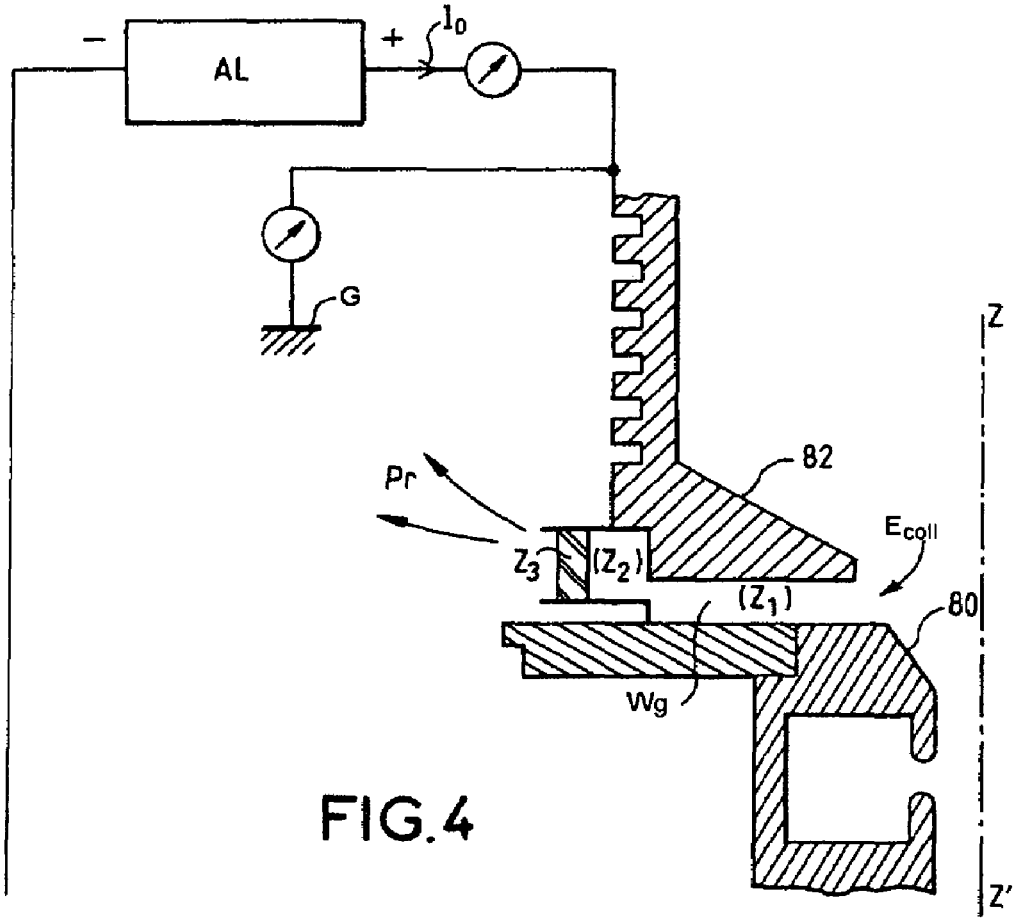
FIG. 4, already described, shows a detailed view of the coupling zone of a microwave tube.
Figure 5D:
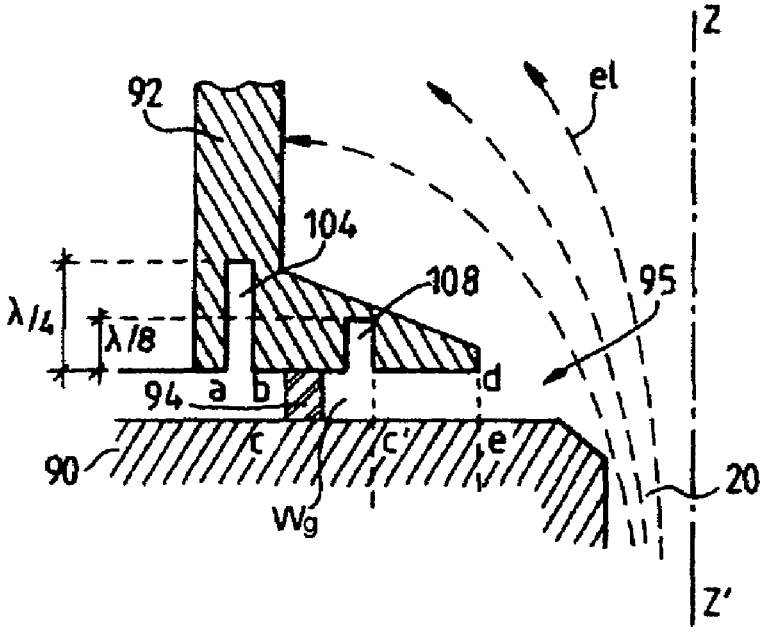
FIG. 5*d* shows another alternative embodiment of the microwave tube according to the invention.

Moreover, in another alternative embodiment of the microwave tube according to the invention, shown in FIG. 5*d*, the insulator 62 of FIG. 2 or the insulator 94 of FIG. 5*b*, that is to say the insulator that connects the body to the collector (or connects two electrodes of an isolated collector), may be placed closer to the ZZ' axis in such a way that one or more slots are no longer in a vacuum, as in the case of FIG. 5*b*, but in air. However, since the dielectric constant of air is virtually that of a vacuum, this arrangement changes nothing in the invention, but it is a technological variant thereof.

Figure 8A:
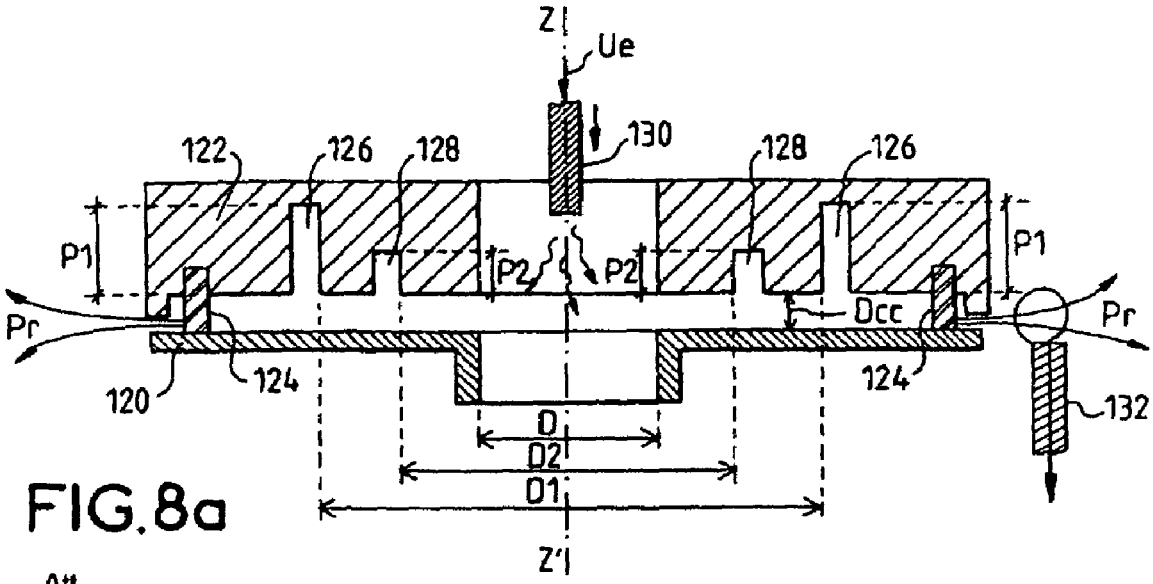
FIG. 8*a* shows a rig for measuring the spurious power radiated in the coupling zone between the body and the collector of a tube according to the invention.

FIG. 8*a* shows a rig for measuring the spurious power radiated in the coupling zone between the body and the collector of a tube according to the invention. The rig comprises a body 120 and a collector 122 that are separated by an insulator 124. The collector has a first slot 126 for the operating frequency F of the tube and a second slot 128 for the frequency 2F, the slots being coaxial with the ZZ' axis of the tube.

In the measurement rig of FIG. 8*a*, the operating frequency is F=4900 MHz and the inside diameters of the body 120 and the collector 122 have diameters D of 33 mm. The distance Dcc separating the body from the collector is 5 mm.

The positions and dimensions of the slots are the following:

first slot 116: diameter D1=105 mm depth P1=15.3 mm second slot 116: diameter D2=63.7 mm depth P2=7.65 mm D1 and D2 about the ZZ' axis.

A microwave signal Pe is injected via an emitter 130 along the ZZ' axis of the tube into the body/collector coupling zone, and a probe 132 is placed outside the tube in the coupling zone in order to measure the radiated spurious power Pr.

Figure 8B:
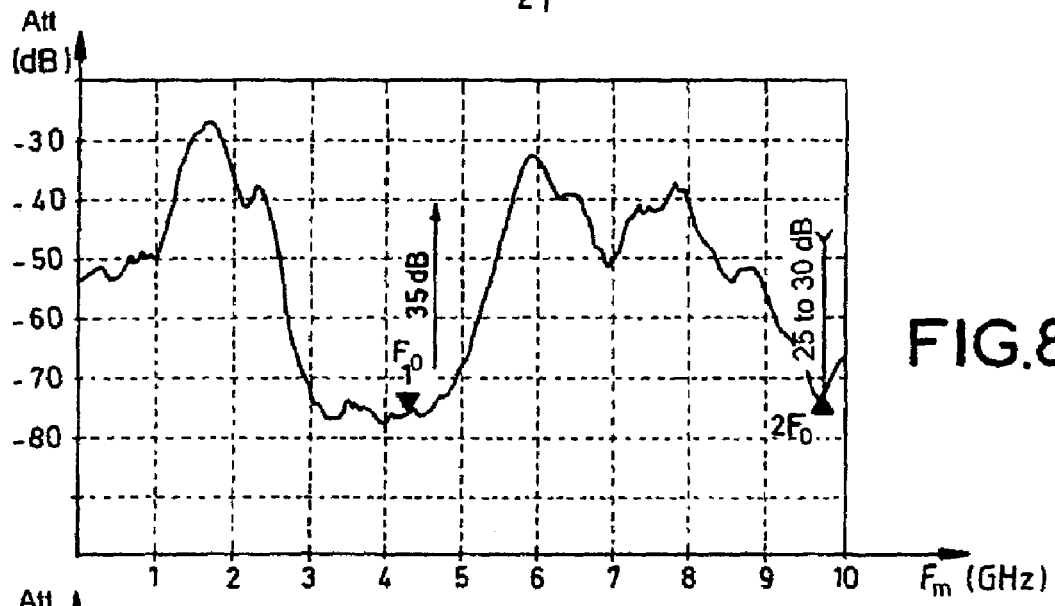
FIG. 8*b* shows a first measurement in the case of a collector having two slots.
Figure 8C:
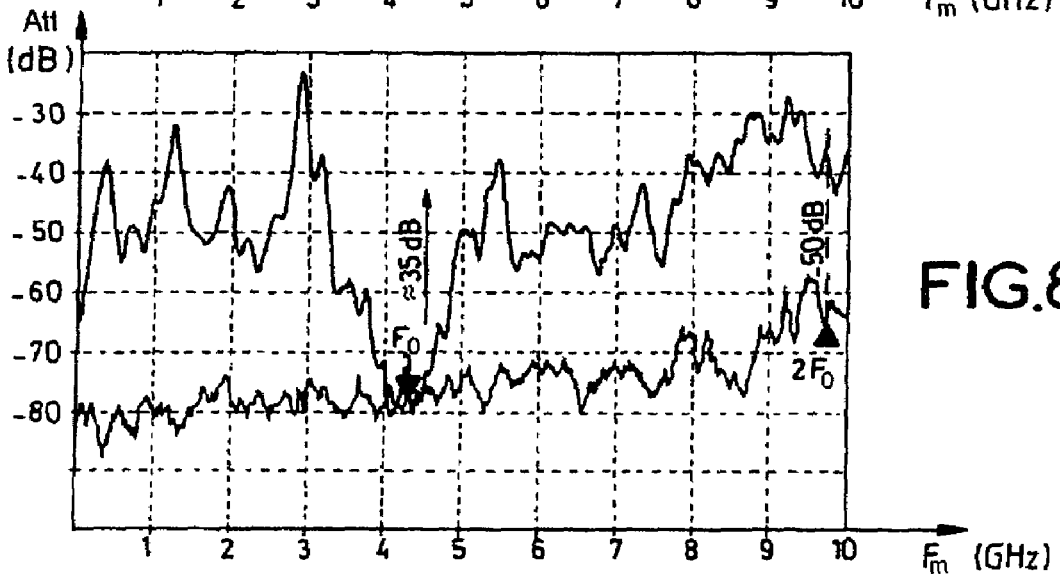
FIG. 8*c* shows the same measurements but with a collector having only a single slot.

FIGS. 8*b* and 8*c* show curves of the attenuation Att as a function of the measurement frequency $F_m$ between the injected signal Ue, injected by the emitter into the measurement rig of FIG. 8*a*, and the spurious signal Pr radiated by the tube and detected by a probe 132, i.e. Att=Pr/Pe.

FIG. 8*b* shows a first curve in the case of a tube having a collector with two slots 126, 128, one for the frequency F and the other for the frequency 2F. It should be noted that the attenuation between the power injected by the emitter 130 and the spurious power detected by the probe 132 is about:

−35 dB at the frequency F; and

−25 dB at the frequency 2F.

FIG. 8*c* shows the same measurements with the same tube of FIG. 8*a*, the collector having a single slot 126 for trapping the frequency F.

Note again there is an attenuation of about −35 dB at the frequency F, but no attenuation at the frequency 2F.

The invention, apart from the substantial attenuation of the spurious radiation, has the advantage that the collector is easily disconnected from the body of the tube, something which is not the case in the embodiments of the tubes of the prior art using insulating resins to mechanically fasten the collector to the body of the tube at the output of the microwave structure.

The invention claimed is:

1. A microwave tube comprising an electron gun generating an electron beam in a cylindrical microwave structure of the tube, the microwave structure delivering a microwave at one output, a collector for collecting electrons from the beam comprising at least one electrode that is mechanically coupled to the microwave structure via a dielectric, the mechanical coupling forming a radial waveguide for propagating spurious microwave radiation from the tube, wherein, in order to attenuate the spurious radiation from the tube, the radial waveguide includes at least one quarter-wave microwave trap having, at least at the operating frequency F of the tube, an open circuit for the microwave propagating in said radial waveguide for propagating spurious radiation.

2. The microwave tube as claimed in claim 1, wherein it includes a microwave trap at the operating frequency F of the tube, having a cylindrical slot collinear with the axis of revolution ZZ' of the tube and emerging in said radial waveguide for coupling the body to the collector of the tube.

3. The microwave tube as claimed in claim 2, wherein it includes another microwave trap at a frequency 2F, having another cylindrical slot collinear with the axis of revolution ZZ' of the tube and emerging in the radial waveguide for coupling the body to the collector of the tube.

4. The microwave tube as claimed in claim 1 , wherein the collector includes a circular slot around the ZZ' axis with a rectangular cross section and a depth equal to λ/4 , the slot emerging via one side in the radial waveguide (Wg), λ=c/F being the wavelength at the operating frequency F of the tube, the slot being at a distance d1 from the point where the radial waveguide emerges on the same side as the internal opening of the collector, such that:

$$d1=(\lambda g/4+k\lambda g/2)$$

λg being the wavelength in the radial waveguide;

k being zero or an integer; and c being the velocity of light in the medium in question.

5. The microwave tube as claimed in claim 2, wherein the collector includes a second slot of circular shape around the ZZ' axis, having a rectangular cross section and a depth equal to λ/8, said second slot emerging alongside the slot in the radial waveguide, the second slot being at a distance d2 from the point where the radial waveguide emerges on the same side as the internal opening of the collector such that:

$$d2=(\lambda' g/4+k'\lambda' g/2),$$

with k' being an integer and λ'g being the wavelength in the radial waveguide (Wg) at the frequency 2F.

6. The microwave tube as claimed in claim 2, wherein the waveguide has, at its input at "ed", a zero impedance or an impedance of very low value (Ved≈0).

7. The microwave tube as claimed in claim 1 wherein the collector is of the "depressed collector" type comprising several mechanically coupled electrodes, each coupling between two consecutive electrodes forming a radial waveguide for propagating spurious microwave radiation (Pr) from the tube, characterized in that, in order to attenuate the spurious radiation from the tube, the radial waveguide between two consecutive electrodes includes at least one quarter-wave microwave trap having, at least at the operating frequency F of the tube, an open circuit for the microwave propagating in said radial waveguide for propagating spurious radiation.

8. The microwave tube as claimed in claim 2, wherein but the slots are filled with dielectric, of low dielectric constant, $\in_r(>1)$, λ, as well as the length of the slots, being reduced in the ratio of the square root of $\in_r$ relative to the case in which the slots are in a vacuum.

9. The microwave tube as claimed in claim 2 wherein one or more slots are in air.

10. The microwave tube as claimed in claim 2, wherein the collector includes a circular slot around the ZZ' axis with a rectangular cross section and a depth equal to λ/4, the slot emerging via one side in the radial waveguide (Wg), λ=c/F being the wavelength at the operating frequency F of the tube, the slot being at a distance d1 from the point where the radial waveguide emerges on the same side as the internal opening of the collector, such that:

$$d1=(\lambda g/4+k\lambda g/2)$$

λg being the wavelength in the radial waveguide;

k being zero or an integer; and c being the velocity of light in the medium in question.

* * * * *